United States Patent [19]

Benzakein

[11] 4,041,988

[45] Aug. 16, 1977

[54] METHOD AND APPARATUS FOR WEAVING AN ELONGATED FABRIC

[76] Inventor: Morris Benzakein, 2130 Bordeleau, Paroisse Notre Dame, St. Hyacinthe, Quebec, Canada

[21] Appl. No.: 681,405

[22] Filed: Apr. 29, 1976

[30] Foreign Application Priority Data

Apr. 29, 1975 United Kingdom ..... 17739/75

[51] Int. Cl.[2] ..... D03D 49/50; D03D 47/42; A44B 19/42

[52] U.S. Cl. ..... 139/116; 139/35; 139/384 B; 139/431

[58] Field of Search ..... 139/430–432, 139/440–442, 116, 35, 11, 384 B, 383 B; 66/1, 14

[56] References Cited

U.S. PATENT DOCUMENTS

| | | | |
|---|---|---|---|
| 2,670,012 | 2/1954 | Voumard et al. | 139/440 X |
| 3,847,188 | 11/1974 | Auer et al. | 139/384 B |
| 3,871,420 | 3/1975 | Jakob | 139/116 |

FOREIGN PATENT DOCUMENTS

| | | | |
|---|---|---|---|
| 871,535 | 1/1942 | France | 139/431 |
| 126,709 | 1/1902 | Germany | 139/441 |
| 1,945,315 | 3/1971 | Germany | 139/35 |
| 49,824 | 6/1965 | Poland | 139/431 |

*Primary Examiner*—James Kee Chi
*Attorney, Agent, or Firm*—Alan Swabey & Co.

[57] ABSTRACT

A method and apparatus for weaving a continuous fabric having parallel selvedges, including a doubleheaded needle being passed from one side of the shed to the other transversely, forming a weft double pick alternately from one side and the other. The apparatus includes an oscillating shaft moving a pair of arms supporting gripper means adapted to grip the needle on either side of the shed as the needle is being passed through the shed.

9 Claims, 10 Drawing Figures

METHOD AND APPARATUS FOR WEAVING AN ELONGATED FABRIC

BACKGROUND OF THE INVENTION

1. Field of the Invention

The present invention relates to a method and apparatus for weaving an elongated fabric, and more particularly, to the weaving of webbing, woven tapes, or ribbons of indefinite length and parallel edges comprises a set of warp yarns interwoven with two weft threads, wherein picks of the respective weft threads extend across the warps in alternating relation, and when at each edge of the fabric, loops of the two weft threads are linked together to form selvedges.

2. Description of the Prior Art

On conventional needle looms the weft pick is inserted as a double pick from one supply package at one side of the loom by virtue of its being threaded through the needle eye of an insertion needle which crosses the opened shed and dwells while a knitting latch needle either protrudes through the loop formed by the double pick, to pick up a catch thread and retracts, or picks up the loop formed by the double pick and retracts. The weft insertion needle then retracts and dwells while the shed changes and the beat up motion takes place. We can now describe the weft insertion motion as going from a full stop to its maximum speed, stopping, and then being retracted as it accelerates again to its maximum speed and the stops and the cycle is repeated to provide the insertion of one double pick.

SUMMARY OF THE INVENTION

It is an aim of the present invention to provide an improved method of weaving a fabric of indefinite length with parallel edges which is simpler in operation. It is also an aim of the present invention to provide an apparatus for carrying out the method which is simpler and more economical in construction and has fewer moving parts.

It is a further aim of the present invention to provide a method and apparatus for forming and incorporating a zipper monofilament woven in the tape with the heads of the zipper extending along one of the parallel edges of the tape.

A method in accordance with the present invention includes the steps of providing a plurality of warp yarns and inserting alternately from each side of the shed double picks of a pair of weft threads taken from a stationary weft supply on either side of the shed nd interlacing the loops along the edges of the web so formed to form a chain stitch at both edges providing selvedges.

A construction in accordance with the present invention includes a double-headed latch needle, a first gripper means on one side of the shed path for gripping the needle, and passing said needle transversely through the shed while it is pulling a first weft pick, second gripping means on the other side fo the shed for gripping the needle as the needle passes through the shed and withdrawing the needle from the shed, means for simultaneously actuating said first gripper means to release the needle, means for reversing the travel of the needle and simultaneously picking up a second weft pick while releasing the first weft pick, said gripping means passing the needle transversely through the shed in the opposite direction while pulling the second weft pick through the loop formed by the first weft pick.

A further aspect of the present invention includes a method and apparatus for incorporating at least a zipper monofilament in the so-formed fabric by first preforming the head and prescoring at the bending points of the zipper loop on the monofilament, introducing the monofilament as a warp yarn and hooking the monofilament warp yarn to pass it outwardly of the fabric through the knitted selvedge being formed, while the monofilament is being anchored and held at the bending points by at least a wire weaving as mock warp filament.

BRIEF DESCRIPTION OF THE DRAWINGS

Having thus generally described the nature of the invention, reference will now be made to accompanying drawings, showing by way of illustration, a preferred embodiment thereof, and in which.

FIG.. 9 is a fragmentary enlarged top plan view of a detail of another embodiment of the present invention.

DESCRIPTION OF THE PREFERRED EMBODIMENTS

Figure 1:
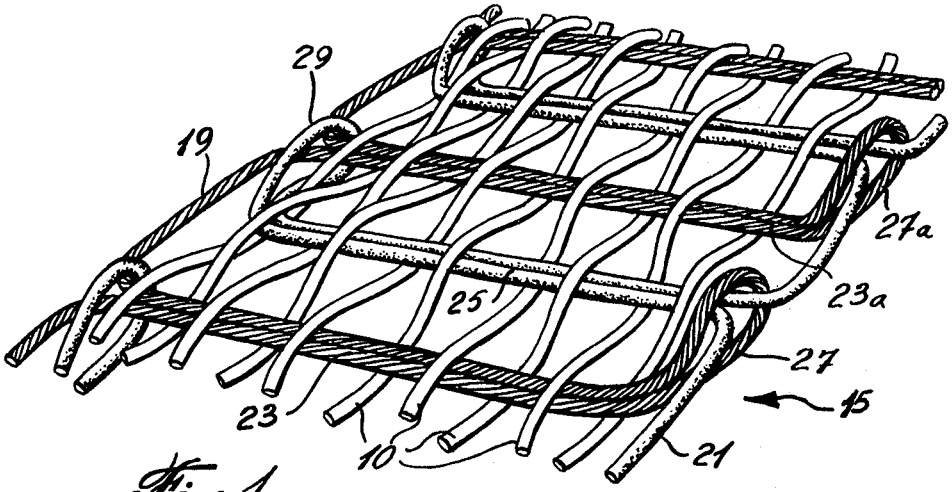
FIG. 1 is a perspective view of a typical elongated fabric showing the double pick weft threads forming the selvedges on either side edge of the fabric.
Figure 2:
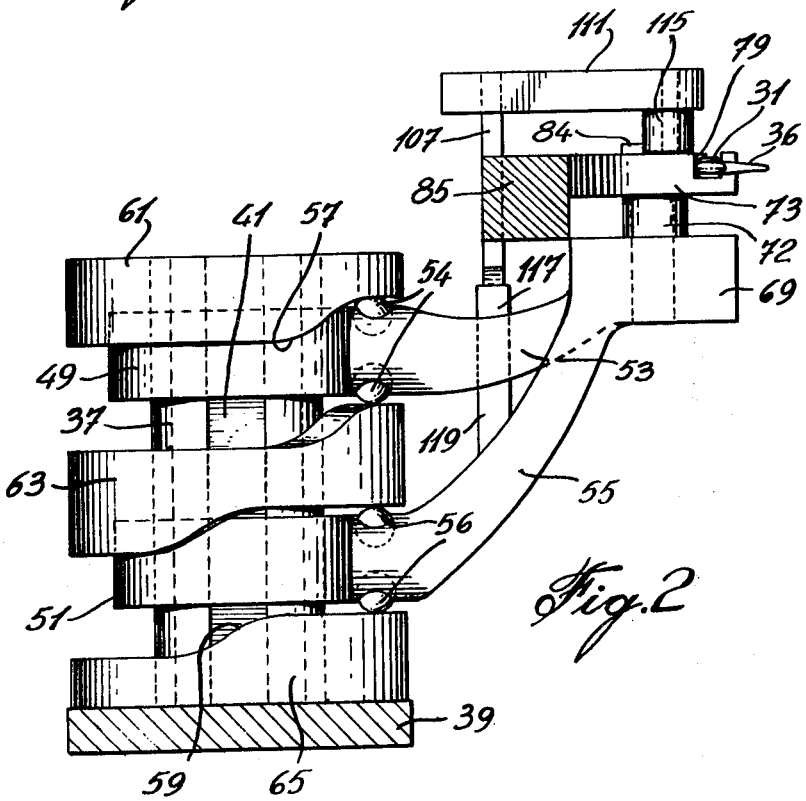
FIG. 2 is a fragmentary side elevation showing the apparatus in accordance with a preferred embodiment of the present invention.

Referring to FIG. 1, there is shown a tape 15 made up of a plurality of warp yarns 10. A weft yarn 19 extends along the left side of the fabric in FIG. 1 while the weft yarn 21 extends along the right side of the fabric. Both weft yarns 19 and 21 pass alternately through the warp yarns 10 and are in the form of double picks 23 and 25 respectively. The first weft double pick 23 extends from left to right between the warp yarns 15 to form a loop 27 on the right-hand side of the fabric. The second weft double pick 25 passes through the loop 27 on the right-hand side of the fabric from right to left through the warp yarns 15 to form on the left-hand side of the fabric a loop 29. The double pick 23*a* now passes through the loop 29 and forms a new loop 27*a* on the righthand side of the fabric. The loops 27 and 29 form the selvedges on either edge of the fabric.

Figure 3:
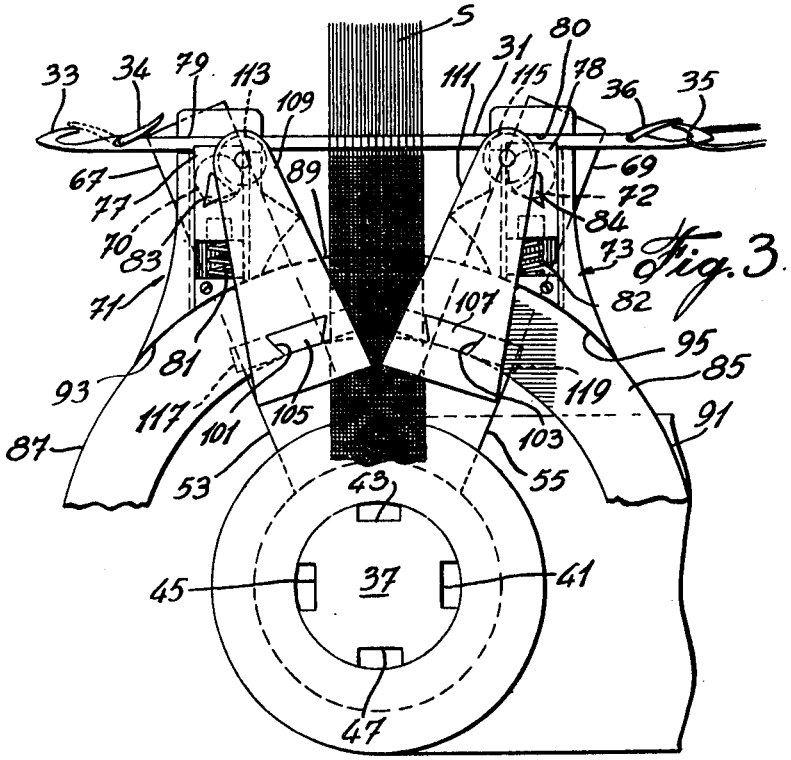
FIG. 3 is a fragmentary top plan view of the apparatus shown in FIG. 2, but showing partially the fabric being woven in the shed path.

The loops 27 and 29 are formed by a double headed latch needle 31 having hooks 33 and 35 with respective latches 34 and 36 shown, for instance, in FIG. 3.

An upright shaft is journaled in a suitable frame (not shown), and an arm 39 is fixed to the shaft 37. Suitable mechanical means are provided to oscillate the shaft 37 by means of the arm 39. The shaft 37 is provided with four vertical slots 41, 43, 45 and 47. Collars 49 and 51 engage the slots 41, 43, 45 and 47 and are adapted to oscillate with the shaft 37. However, the collars 49 and 51 can slide on the shaft 37 along a vertical axis.

Fixed to the collar 49 is a support arm 53 while a support arm 55 is fixed to a collar 51. Although the collars 49 and 51 are at different vertical levels, the support arms 53 and 55 are arranged such that the arms operate in parallel, vertical planes, as will be described further. Cam tracks 57 and 59 are formed by cylindrical members 61, 63 and 65 which are mounted to the support frame (not shown). The arms 53 and 55 are arranged to follow cam tracks 57 and 59 respectively. Frictionless devices, such as ball bearings 54 on the arm 53 and 56 on the arm 55, are arranged to enable the arms 53 and 55 to follow in cam tracks 57 and 59 with the least resistance.

Each arm 53 and 55 includes a support block 67 and 69 respectively. A carriage 71 is mounted on the support block 67 by means of a pivot shaft 70. A similar carriage 73 is mounted on the support block 69 by means of the pivot shaft 72. Each carriage 71 and 73 includes a central slot 75, and sliding gripping members 77, 78 are spring mounted in the respective central slots 75 in a direction towards a transverse slot 79, 80, which is adapted to receive the needle 31. The gripping members 77, 78 are urged by springs 81, 82. The sliding gripping members 77, 78 each have triangular-shaped, vertical cam projections 83, 84, as will be described later.

Figure 4:
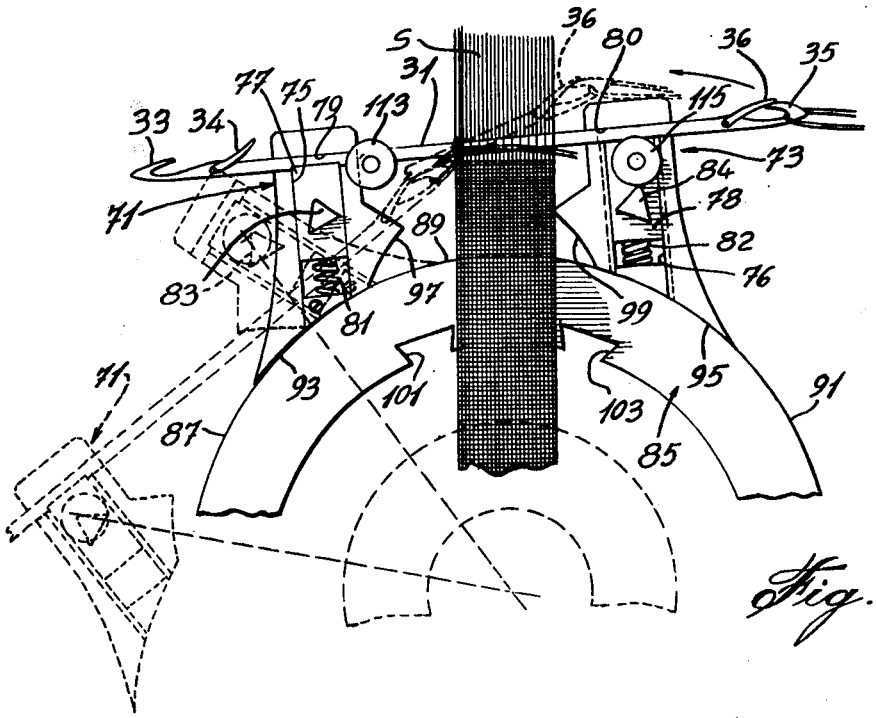
FIG. 4 is a fragmentary top plan view similar to FIG. 3 with part of the element removed and showing in dotted lines different positions of the apparatus.

A cam member 85 is provided having an arcuate camming surface divided for purposes of description into sections 87, 89 and 91. Section 89 is defined by an arc, the radius of which is at the center of the shaft 37. Sections 87 and 91 curve inwardly. As seen in FIGS. 3 and 4, the carriage 71 and 73 have follower surfaces 93 and 95 respectively which, when the carriages are in a central position as shown in FIG. 3, the surfaces 93 and 95 mate or contact with the surface 89 such that the carriages are held parallel. However, as the carriages move away from the section 89, for instance, they are capable of rotating freely about a vertical axis through the pivot shafts 70 and 72 respectively. Arcuate surfaces 97 and 99 act as stops limiting the rotation of the carriages 71 and 73, by engaging the respective arcuate surfaces 87 and 91. The cam member 85 is also mounted to a support frame (not shown) and is fixed relative to the cam members 61, 63 and 65.

A pair of dove-tail vertical slots 101 and 103 is provided in the cam member 85 as shown in FIGS. 3 and 4. Vertical sliding members 105 107 extend through the slots 101 and 103 and individually mount cantilever members 109 and 111. Cantilever members 109 and 111 each have a cam roller 113 and 115 which are adapted to engage the triangular cam members 83 of the respective grip carriages 71 and 73. The cantilever members 109 and 11 are caused to move in a vertical plane by means of the lower ends of sliding members 105 and 107 engaging cam members 117 and 119 mounted on the arms 53 and 55 respectively. The shed is identified by the letter S.

The operation will be described with reference to FIGS. 2 through 8, and with particular reference to FIGS. 5 through 8.

Figure 5:
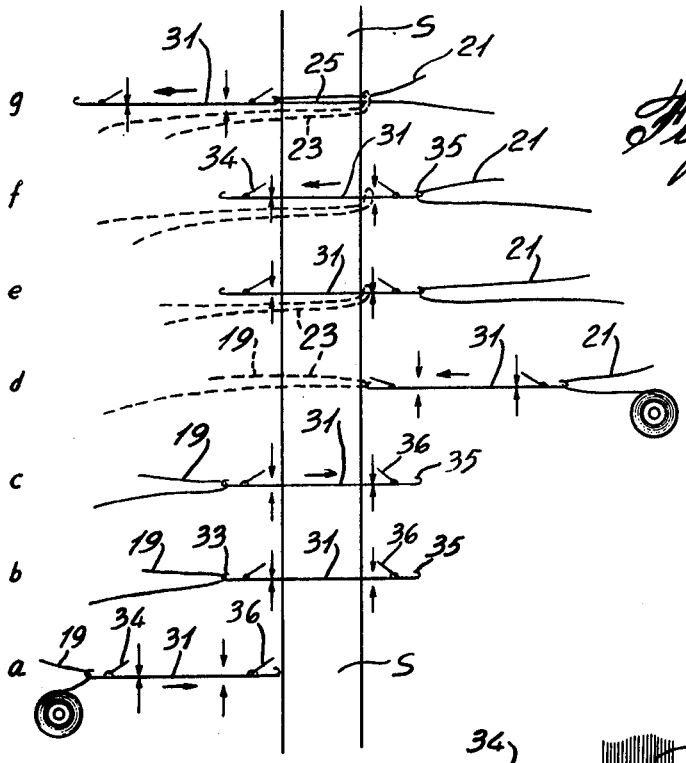
FIG. 5 is a schematic diagram showing successive positions of the double-headed latch needle as it is being moved by the apparatus shown in FIGS. 2 to 4.
Figure 6:
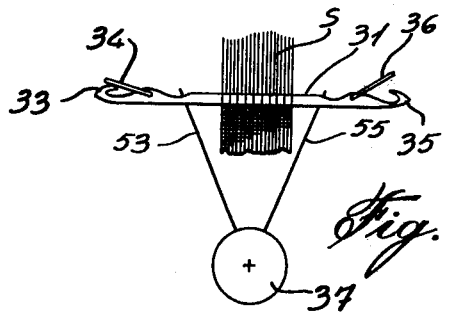
FIGS. 6, 7 and 8 are schematic top plan views showing successive steps of the apparatus.
Figure 7:
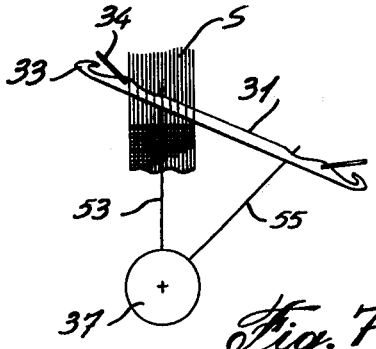

In FIGS. 5, step "*a*" shows the needle 31 on the left-hand side of the shed S which would be somewhat in the position shown in dotted lines in FIG. 4. At this point, the latch 34 of needle 31 is open, and the yarn 19 to form a double pick weft 23 is gathered by the hook 33. The gripper 77 engages the needle 31 in the slot 79 on the carriage 71. In a preferred construction, the front lip of the gripper 77 is slanted and has a serrated engaging face adapted to engage similar serrations on the needle 31. As the oscillating arm 39 moves, the shaft 37 is rotated clockwise, forcing the needle through the loop 29 thereby causing the latch 36 to open. As the shaft 37 continues to move clockwise, the arm 53 carrying the carriage 71 continues in the highest plane of the track 57 formed by cam members 51 and 63 while the carriage 73 mounted on arm 55 travels through the lowest plane of the track 59 such that the carriage 73 passes underneath the shed. As the arms 53 and 55 approach the position shown in step "*b*"of FIG. 5 in the full-line position shown in FIG. 4, the arm 55 will move upwardly following the track 59, and simultaneously the triangular shaped cam 84 will approach and engage the cam wheel 115, and as it passes the cam wheel 115, the gripper 78 will be slid back against the spring 82 on the carriage 73, thereby opening and allowing access to the slot 80 to receive the needle 31. At a position between step "*b*" and step "*c*", momentarily the needle 31 will be gripped by both the grippers 77 and 78.

However, as shown in FIG. 3, the cam roller 113 mounted on the cantilever support member 109 will engage the triangular cam projection 83, forcing the gripper 77 to slide back against the spring 81 on the carriage 71 to thereby disengage itself from the needle 31.

The gripper 78, once it has passed the roller 115, now engages the needle 31 in its slot 80 and moves the needle through the shed S. The carriage 71 mounted on the arm 53 will now follow downwardly along the cam track 57 so that the gripper 77 on the carriage 71 will clear the shed S.

Figure 8:
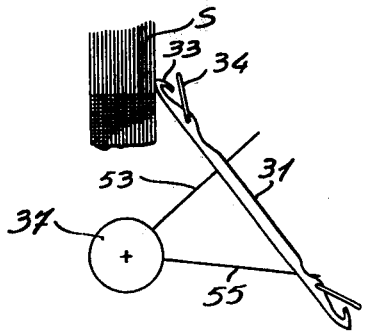

As the carriage 73 moves from the can surface section 89, it is free to rotate about its axis on shaft 72 and will thereby provide the necessary angle change of the needle 31 as it follows through the loop 27 of the shed S. Once the arm 39 has moved to its extreme clockwise osicllating position, the shaft 37 will have moved the arm 55 and, therefore, the carriage 73 and the needle 31 to the extreme right-hand position as shown in FIG. 8, as well as step "*d*" of FIG. 5. In this position, the latch 34 has now been closed by passing through a loop 29, but has now formed a double pick 23 with the loop 27.

As the oscillating arm 39 begins its couterclockwise position, the open hook 35 will grip a yarn 21 and latch 34 will thus be opened by moving back through the loop 27. As the carriage 73 and gripper 78 move the needle 31 counterclockwise through the shed S, it approaches a position whereby the cam roller 113 will again engage the cam projection 83 on gripper 77, thereby opening it, and at the same time, the carriage moves upwardly by means of the arm 53 following the track 57, and simultaneously the cam roller 113 on the horizontal cantilever support 109 moves upwardly with the carriage. The sliding member 105 is forces upwardly in the slot 101 by means of cam member 117 on the arm 53. The carriage 71 is held parallel to carriage 73 since the surfaces 93 and 95 of the carriages are in mating contact with the cam surface 89. At that point, the needle 31 engages the slot 79, and as the counterclockwise movement continues, the cam projection 83 disengages itself from the roller 113 allowing the gripper 77 to close on the needle 31 under the urging of the spring 81. Subsequently, the cam projection 84 meets the cam roller 115 opening the gripper 78 and allowing the needle 31 to be disengaged from the slot 80. At the same time, the arm will move downwardly following the track 59 and thus only the gripper 77 on the carriage 71 will be engaging the needle 31. As the needle 31 continues its cycle through steps "*e*" and "f", it eventually arrives at the extreme left position of step "*g*" carrying the double pick 25 through the shed S forming a loop 29, and the cycle will have been completed.

Figure 9:
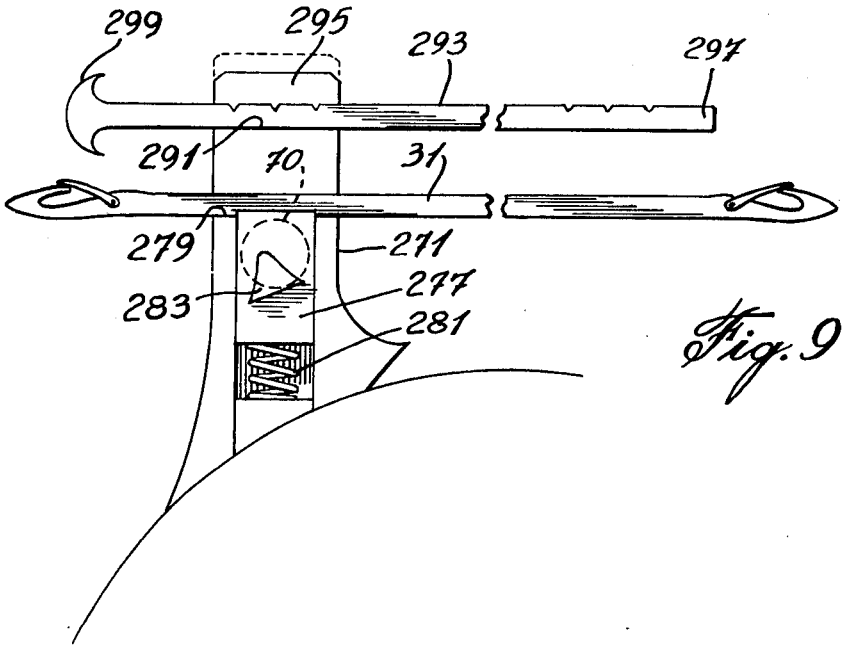

Referring to FIG. 9, there is shown a modified carriage 271 having a sliding gripper 277, a spring 281, the triangular cam projection 283, and transverse slot 279. The needle 31 is engaged by the gripper 277 in the slot 279. The carriage 271, however, includes a second slot 291 adapted to hold a needle 293 by means of a spring loaded gripper 295. The gripper 295 could be pivoted at the end of the carriage 271 and include a downwardly extending leg adapted to engage a cam (not shown) which is in a position corresponding to the wheel 113 in FIGS. 3 and 4 so as to open the gripper 295.

Figure 10:
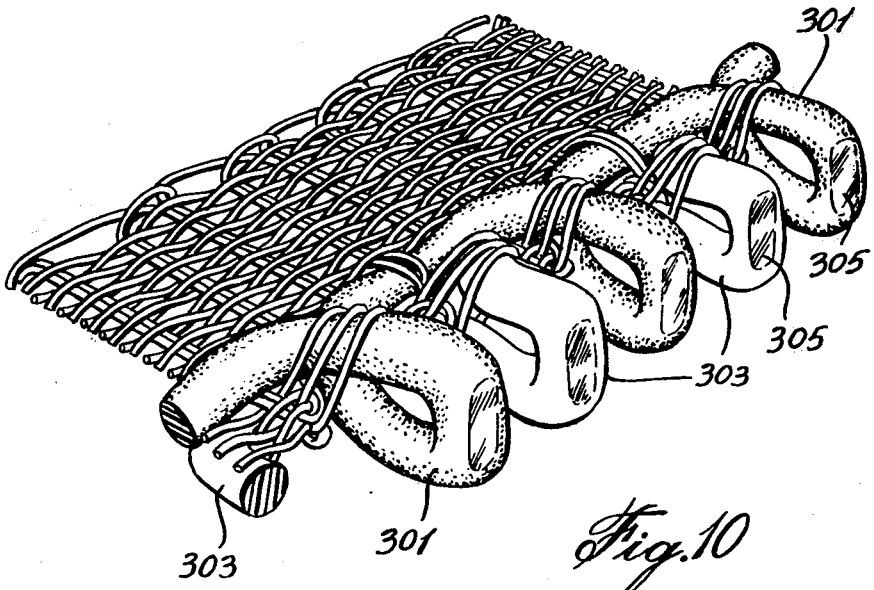
FIG. 10 is a fragmentary enlarged perspective view of the fabric with a monofilament zipper incorporated therein.

The needle 293 is adapted to pass through the shed simultaneously with the needle 31, and the gripper 271 along with a companion gripper, not shown, would pass both the needles 31 and 293 through the shed. Needle 293, however, has a blank end 297 and a double hook end 299. As the needle 293 passes through the shed on the counterclockwise movement of the shaft 37, it will not engage any particular warp. In the shed, there is provided a pair of prescored and preformed monofilaments 301 and 303 which would be of a suitable polymeric material. The monofilaments 301 and 303 would have preformed, zipper heads 305. A pair of mock warp threads could be provided adjacent the monofilaments 301 and 303 in order that when the heads 305 were pulled through, the filaments would bend at the prescored location against the mock warp threads which may be of wire. As the needles 31 and 293 are passed through the shed in a clockwise movement, the hook 299 on needle 293 engages a monofilament 301 or 303 alternately in the area of the head 305 and pulls it through to be exposed beyond the selvedge as shown in FIG. 10.

Of course, two monofilaments 301 and 303 are used, and they are alternately picked by the needle 293, and they would be strategically spaced near the top or bottom of the shed in order to best program which monofilament is to be hooked as the needle 293 passes therethrough.

I claim:

1. A method for forming a continuous fabric having parallel edges, including the steps of providing a plurality of warp yarns and inserting alternately from each side of the shed double picks of a pair of weft yarns taken from a stationary weft supply on either side of the shed and interlacing the loops along the edges of the web so formed to form a chain stitch at both edges, providing a pair of mock warp yarns in the shed near one side edge of the web, and locating at least a monofilament, which has been prescored to form a part of a zipper, as a warp adjacent the mock warp yarn inwardly thereof and successively pulling the monofilament through the mock warp yarn and the edge as it is being formed on one side edge thereof.

2. A method as defined in claim 1, wherein a first weft yarn is picked from one side of the shed, passed transversely through the shed to form a loop on the opposite side of the shed and successively a second weft yarn is picked from the other side of the shed through the loop formed by the first weft yarn and brought transversely across the shed to the first side of the shed to form a loop, and the cycle is repeated.

3. A method as defined in claim 1, wherein two monofilaments are located as warp yarns, and each is pulled alternatively through the one side edge of the web to form part of a zipper.

4. An apparatus for weaving a continuous web of fabric having parallel side edges, including a double headed latch needle, a first gripper means on one side of the shed path for gripping the needle, and passing said needle transversly through the shed while it is pulling a first weft pick, second gripping means on the other side of the shed for gripping the needle as the needle passes through the shed and withdrawing the needle from the shed, means for actuating said first gripper means to release the needle, means for reversing the travel of the needle and simultaneously picking up a second weft pick while releasing the first weft pick, said second gripping means passing the needle transversely through the shed in the opposite direction while pulling the second weft pick through the loop formed by the first weft pick.

5. An apparatus as defined in claim 4, wherein said first gripper means in actuated to grip the needle as it is passed through the shed transversely by means of the second gripper means, means for successively releasing the second gripper means from the needle, means for actuating the first gripper means to pass the needle completely through the shed to form a loop with the second weft pick.

6. An apparatus as defined in claim 5, wherein the first and second gripper means each include a carriage adapted to be moved to and from the shed path respectively on either side thereof, the carriage including a sliding slot in which a spring-urged gripper is urged forward towards a transversely extending recess in the carriage adapted to receive a needle, and cam-operated means are provided for actuating the sliding gripper to release the needle and to grip the needle when necessary.

7. An apparatus as defined in claim 6, wherein a second transverse slot is provided on the carriage for holding a needle having hooks at only one end thereof to pick the monofilament to form a loop of a performed zipper member.

8. An apparatus as defined in claim 6, wherein an upright oscillating shaft is provided below the shed path, a first arm connected to the shaft and mounting a first gripper means including the carriage thereof, a second arm connected to the shaft and mounting the second gripper means including the carriage thereof, cam means for moving the arms vertically as the shaft is being osicllated so that the carriages including the gripper means can move below the shed path when the respective gripper means are not carrying the needle as the shaft is being osicllated.

9. An apparatus as defined in claim 8, wherein cam means are fixed to a frame for controlling the regular movement of the carriages which are in turn pivoted to the respective arms, while the carriages are both gripping the needle momentarily and parallel to the edges of the shed path.

* * * * *